United States Patent [19]

Tappe et al.

[11] 4,339,499

[45] Jul. 13, 1982

[54] STRING OF A SYNTHETIC RESIN

[75] Inventors: Günther Tappe, Troisdorf-Sieglar; Bertram Gasper, Troisdorf-Spich; Herbert Laubenberger; Richard Weiss, both of Troisdorf, all of Fed. Rep. of Germany

[73] Assignee: Dynamit Nobel Aktiengesellschaft, Troisdorf, Fed. Rep. of Germany

[21] Appl. No.: 136,701

[22] Filed: Apr. 2, 1980

[30] Foreign Application Priority Data

Apr. 11, 1979 [DE] Fed. Rep. of Germany ..... 2914606

[51] Int. Cl.[3] ..... D02G 3/00

[52] U.S. Cl. ..... 428/373; 57/243; 57/250; 84/297 S; 264/210.7; 273/73 A; 273/73 C; 273/73 R; 428/391; 428/394

[58] Field of Search ..... 428/364, 378, 373, 374, 428/375, 394, 421, 422, 391; 57/200, 250, 243, 258, 232, 234, 241, 242; 264/210.7; 273/73 R, 73 A, 73 C; 84/297 S

[56] References Cited

U.S. PATENT DOCUMENTS

| | | | |
|---|---|---|---|
| 3,376,370 | 4/1968 | Koblitz et al. | 264/210.7 X |
| 3,579,370 | 5/1971 | Punderson et al. | 428/422 |
| 3,649,434 | 3/1972 | Mortenson | 428/421 |
| 3,941,860 | 3/1976 | Couchoud et al. | 264/210.7 X |
| 3,965,232 | 6/1976 | Chion et al. | 264/210.7 X |
| 4,202,164 | 5/1980 | Simpson et al. | 57/258 X |

*Primary Examiner*—Lorraine T. Kendell

*Attorney, Agent, or Firm*—Craig and Antonelli

[57] ABSTRACT

A string for the stringing of rackets, bows, musical instruments and the like which has a thread-like structure of polyvinylidene fluoride. The string is obtained by extruding a rod of polyvinylidene fluoride at a melt temperature of the polyvinylidene fluoride, cooling the rod at a temperature between 60°-150° C., and then axially stretching the rod at this temperature following by cooling the rod to room temperature and thereafter cold-stretching the monofil. The string is characterized by an elasticity that approaches that of natural gut string.

12 Claims, 9 Drawing Figures

STRESS-ELONGATION DIAGRAM OF (1) NATURAL GUT STRINGS, (2) "SYNTHETIC RESIN STRINGS" OF PA, (3) PVDF MONOFIL STRING

TORSION PENDULUM TEST ACCORDING TO DIN 53 445 OF: (1) NATURAL GUT STRINGS, (2) "SYNTHETIC RESIN STRINGS" OF PA, (3) PVDF MONOFIL STRINGS

ELASTICITY AS A FUNCTION OF THE PRETENSIONING FORCE OF: (1) NATURAL GUT STRINGS, (2) "SYNTHETIC RESIN STRINGS" OF PA, (3) PVDF MONOFIL STRING

CHRONOLOGICAL CURVE OF TENSION AFTER APPLICATION OF A FORCE OF 200N, (1) NATURAL GUT STRINGS, (2) "SYNTHETIC RESIN STRINGS" OF PA, (3) PVDF MONOFIL STRING, (4) PVDF MONOFIL STRING, NOT COLD-STRETCHED SUBSEQUENTLY.

STRESS-ELONGATION DIAGRAM CONSTANT ELONGATION STRING.

CHRONOLOGICAL CURVE OF THE FORCE AT NATURAL GUT STRINGS, (2) PVDF MONOFIL

EQUILIBRIUM MOISTURE CONTENT AS A FUNCTION OF RELATIVE HUMIDITY AT 23° C. OF:
(1) NATURAL GUT STRINGS,
(2) "SYNTHETIC RESIN STRINGS" OF PA 6.6

POLYAMIDE 6.6: (1) DRY (2) SATURATED AT 23° C., 50 % REL. HUMIDITY
(3) SATURATED IN WATER AT 23° C.

STRING OF A SYNTHETIC RESIN

This invention relates to a string formed of a synthetic resin and a process for the production of such strings.

Strings consisting at least partially of a synthetic resin are conventional; see for example DOS [German Unexamined Laid-Open Application] No. 2,728,339 and DOS No. 1,703,132. Such strings are utilized for various purposes, especially as strings for musical instruments, as well as strings for stringing rackets, especially tennis, squash, badminton rackets, etc., and also as strings for bows and crossbows. For all of these applications, the racket strings, bow strings, or the like must exhibit specific properties with respect to tensile strength and the elongation upon short-term and repeated stress. After such a stress, the strings must return rapidly and completely to their initial length. Finally, the strings are to possess also a high strength under the various conditions occurring during use, especially a high abrasion resistance, a good flexibility, an extensive independence of the properties from the environmental conditions, as well as in total a high stability with respect to the various loads to which the strings are exposed during mounting to the various supports for which the strings are intended. The profile of requirements for tennis racket strings is shown, for example, in the periodical "Test," No. 6 (1978), pp. 512–517.

Gut strings have been used for a long time for musical instruments and for stringing high-quality tennis rackets. The recuperative capacity of these gut strings, i.e. their capability to rapidly and completely reassume the original length after a short-term or a repeated stress, is excellent. Furthermore, in case of gut strings, the increase in length or the elongation depending on the tensile force exerted is linear and remains practically unchanged from one load cycle to the next, which is evidence of the absence of flow. However, all tensile elongation force curves exhibit steps or jumps produced by the onset of tearing of certain individual fibers of the gut strings or the unraveling or untwining of turns of the strings provided with a twist. The above-described phenomena correspondingly reduce the lifetime of gut strings. In gut strings, the lifetime is clearly proportional to the diameter of the string; however, it is not readily possible to simply increase this diameter since this increase leads to various disadvantages, particularly with respect to the elasticity of the string under tensile stress. Furthermore, gut strings do not exhibit a uniform quality either, since the quality depends on the type of gut utilized (e.g. sheep, cattle or pig gut), as well as on the storage conditions for the strings and on the moisture conditions ambient at the moment the strings are used. Since natural gut strings show a high moisture absorption, a consequence of which is the occurrence of dimensional changes, i.e. elongation of the string, the elastic characteristic changes vary considerably and to the disadvantage of the players. Moreover, gut strings are pronouncedly expensive to manufacture.

In recent times, several different strings have been developed, consisting at least partially of a synthetic resin, especially thermoplastic synthetic resins. These strings, as hereinafter described, have a structure which frequently is more or less complicated, for example:

1. Monofil strings, heretofore have been conventionally extruded from polyamide, such as nylon, from modified polyvinyl chloride, from polyurethane, or from a polyester, such a polyethylene terephthalate, or also from a polyolefin such as polyethylene or polypropylene. (It will be understood that the term "monofils" refers to relatively thick, extruded fibers or threads having a diameter of at least 0.1 mm preferably up to 1,5 millimeters, which are extruded as individual fibers.) The manufacture of these strings is economical and thus desirable, and the strings exhibit high strength during use. However, these monofil strings have the disadvantage that—even after being stressed by a relatively weak tensile force—the monofil strings return only gradually into their initial condition, due to their internal friction, and that the strings experience irreversible lengthening under a relatively high tensile stress. Besides, extruded monofil strings become brittle, inter alia, at low temperatures; this holds true especially for polyamide strings.

2. Other strings consist of a bundle of parallel multifilaments which are not impregnated into the core and which are merely surrounded, namely entirely on the outside, by an envelope or casing of an extruded synthetic resin material. The thus-constructed strings exhibit the disadvantage that they show little resistance to bending stresses and in practical usage, the thin envelope has only a poor abrasion resistance.

3. Another group of strings are in the form of a flat bundle of parallel multifilaments impregnated by extrusion with a thermoplastic material, for example with a polyamide, wherein the flat bundle (or the strap, or the ribbon) produced in this manner is subsequently twisted at an elevated temperature. The strings thus produced exhibit the disadvantage that the twist unwinds when the string is subjected to tensile stress.

4. Yet another group of strings represent a combination of the aforementioned types of strings with respect to their structure. For example, these include strings with a monofil, extruded core of a thermoplastic material which is surrounded, for reinforcement purposes, with windings of a thread, a strap, or a ribbon, or which is surrounded by a casing or a braided envelope, wherein this casing is impregnated. The provision of a reinforcing thread or the like increases the tear strength of the string only if its ultimate elongation is higher than that of the other string component, e.g. a thread or filament to be reinforced. In general, the reinforcing threads, for example, metal, carbon, or boron filaments, have a higher ultimate tensile strength and a higher modulus of elasticity, but a lower ultimate elongation than the string component of the monofil to be reinforced. If the ultimate elongation of the reinforcing thread is exceeded, then the original thread or filament which is reduced in cross section, is the sole bearer of the stress. Besides, such multifilament strings are considerably more expensive in their manufacture than monofil strings.

The predominant part of the strings presently manufactured, which consist at least partially of a synthetic resin, have hysteresis curves disclosing an initial flow and indicating that, after a number of successive stresses, a permanent elongation remains. For all these reasons, the presently available strings produced from synthetic resin materials are not fully satisfactory, especially if the strings are to be used as stringing for tennis rackets. Although the conventional strings wherein at least one process step takes place for the extrusion of thermoplastic materials, particularly for the production of a monofil core or an impregnation of a band of multifilaments, can be manufactured very economically, continuously and rapidly, the artificially produced strings are, on the other hand, not competitive in quality with the natural gut strings, namely primarily due to specific properties, especially the inadequate recovery power of the thermoplastic materials employed as well as the insufficient elasticity.

The multifil synthetic resin strings are still inferior as a tennis racket stringing to the high-quality natural gut strings with regard to playing characteristics, and are at most comparable to the lower quality natural gut strings. Furthermore, the purely synthetic resin monofils exhibit the poorest playing properties, due primarily to an inadequate elasticity. In the production of conventional monofil and multifil synthetic resin strings, polyamide 6 and 6.6, as well as, to a minor extent, polyethylene terephthalate are preferably utilized.

Furthermore, another disadvantage to natural gut strings as well as synthetic resin strings, especially of polyamide, is the moisture absorption and emission, respectively. Depending on the respective atmospheric humidity and the ensuing moisture content of the strings, the strings, in their strung condition, can contract or or expand in length. Even in case of a synthetic resin of such high quality as polyamide 6 and 6.6, dimensional variations of about 2% are still observed upon a change in relative atmospheric humidity of 25–80%; in case of natural gut strings, these variations are about 4%. On account of these dimensional changes, a reduction in the pretensioning force of the tightened string occurs with an increase in the moisture content of the strings; thus, for example, the stringing of a tennis racket becomes relaxed and the ball is no longer accelerated. Upon a reduction in the moisture content of the strings, on the other hand, a shortening of the strings occurs and the pretensioning forces are increased; the tightened string becomes harder. A particular disadvantage of strings made of polyamide is due to the fact that, with a moisture content of the polyamide of about 3%, occurring at atmospheric humidities of 50% relative humidity, the glass transition zone of polyamide 6 and 6.6 is already at about 20° C. For this reason, these strings have a high attenuation, and the strings exhibit a poorer restoring power due to internal friction. Besides, in these polyamide strings, strong variations in elasticity are experienced in case of temperature changes.

Starting with the prior art, the invention is based on the object of providing a string of a synthetic resin material exhibiting practically the advantages of gut strings and the advantages of the conventional strings of synthetic resin materials, without exhibiting the disadvantages thereof; and a process for the production of such strings.

This object has been attained according to the invention by utilizing polyvinylidene fluoride to form the synthetic resin string. It has now been found, surprisingly, that the synthetic resin strings of this invention made of polyvinylidene fluoride do not show a high attenuation at room temperature and, therefore, rebound faster; that such strings are, at the same time, more elastic than all heretofore known synthetic resin strings; and that the strings do not age as rapidly. It has been possible to make the strings of polyvinylidene fluoride approach, with regard to their elasticity or elastic behavior, that of high-quality natural gut strings. Moreover, as compared with strings of natural gut and particularly of polyamide, the disadvantage incurred in the latter due to dimensional changes on account of moisture absorption, is avoided, since the moisture absorption of polyvinylidene fluoride in the saturated condition is below 0.2%. This means that polyvinylidene fluoride is substantially more moisture-resistant than the nowadays customary synthetic resin strings of polyamide. This holds true, in particular, for the temperature range from +15° C. to 50° C., important for practical usage. Moreover, strings of polyvinylidene fluoride are among those having maximum weatherability of all the synthetic resin monofils.

It is completely surprising that it has been made possible with the selection of polyvinylidene fluoride according to this invention to create a synthetic resin string having the essential properties of natural gut strings, since this has not been accomplished with the heretofore known strings of polyamide (nylon), polyesters (polyethylene terephthalate), or polypropylene or polyvinyl chloride.

The invention has especially advantageous effects when forming the string of at least one polyvinylidene fluoride monofil; in connection with the monofil string, most interesting from an economic viewpoint, the invention fulfills all expectations and combines the advantages of natural gut strings with the heretofore known synthetic resin strings. However, the string can also consist of several monofil threads of polyvinylidene fluoride which are twisted, braided, plied, or otherwise joined together. This invention is also directed to strings of a complex structure containing, in addition to the synthetic resin filaments, still additional components.

With the great stress to which strings are exposed in working conditions, splitting can also occur in polyvinylidene fluoride monofils. To reduce this splitting, it is proposed, according to the invention, to coat the surface of the polyvinylidene fluoride monofil to reduce frictional resistance and to increase abrasion resistance, for example with the use of a coating of polytetrafluorethylene or silicone oils. The reduced splitting tendency of the strings is of special advantage, in particular, when using the strings as stringing for ball rackets, since here the abrasion resistance of the strings is substantially increased, at least is essentially higher than that of natural gut strings.

The string of this invention is essentially characterized by its elasticity behavior. According to a further feature of the invention, the string is characterized in that the elasticity of the polyvinylidene fluoride monofil, with a pretensioning strength of the string in the range between 170 and 320 N, is adapted to that of a natural gut string. This elasticity of the polyvinylidene fluoride monofil can be set independently of the thickness or the diameter of the monofil, so that identical playing properties are attained independently of the thickness. Another essential property of the string of this invention resides in that the relaxation of the polyvinylidene fluoride monofil is equal to or lower than in natural gut strings, with a comparatively applied pretensioning strength of 200 N. Accordingly, the strings made, according to this invention, of polyvinylidene fluoride monofils are distinguished by high elasticity with a low relaxation. According to another feature of the invention, the elasticity for the string of polyvinylidene fluoride monofils, with a pretensioning strength of 200 N, is between 2.0 and $5.0 \cdot 10^{-4} N^{-1}$, preferably approximately $3.3 \cdot 10^{-4} N^{-1}$.

The ratio between high elasticity of the monofils and low relaxation thereof, required for a string, especially also for the stringing of exemplary rackets, is attained, according to another embodiment of the invention, by axially stretching the polyvinylidene fluoride monofil at a ratio of between 1:3 to 1:10, preferably 1:4 to 1:5. By the choice of the stretching temperature, the stretching conditions, and the residence time, the elasticity can be greatly reduced above an elongation of 7–8%. Thus, it is possible to produce strings having the desired elasticity already during the stretching step under heated conditions. However, if these strings are mounted for a relatively long period of time, it is found that, on the one hand, tension is reduced, while, on the other hand, the elasticity drops as well. Therefore, to set the elasticity desired at room temperature and to make the elasticity uniform over long periods of time, a preliminary stretching step is executed at elevated temperatures so that the strings have an elasticity higher than desired by about 40–70%, and by means of at least one subsequent stretching step under cold conditions the elasticity is brought to the desired value. By the level of the respectively applied tension, the length of the linear dynamic elongation range can be determined.

A particularly advantageous form of the polyvinylidene fluoride monofils of this invention is characterized in that these monofils are subsequently stretched at least one more time. By this subsequent stretching operation, the relaxation of the monofil is reduced, in particular, but the elasticity is likewise reduced, along with the ultimate elongation. Therefore, this subsequent stretching step has its limits.

A preferred field of application of the string according to the invention is the use as stringing of ball rackets, especially tennis rackets. Monofil strings of polyvinylidene fluoride can here be used with special advantage; these strings combining playing characteristics approaching those of high-quality natural gut strings with a corresponding elasticity and relaxation behavior and simultaneously satisfying the requirements of an economical manufacture by extrusion together with exhibiting the advantages of the weatherability of synthetic resins at uniform quality.

As in other macromolecular materials, some of the properties of polyvinylidene fluoride, especially the degree of crystallinity, depend on the thermal prehistory of the material as well. While an extensively amorphous material of good flexibility is produced by rapid cooling after processing, a gradual cooling or tempering at about 135° C. leads to highly crystalline components which, with a higher density, exhibit a higher modulus of tension and flexion and exhibit an improved long-term stability. For the invention a polyvinylidene fluoride with a melt flow index MFI (265° C./12,5 kp) preferably between 15 and 35 g/10 min (DIN 53735) is useful.

Another object of the invention, therefore, resides in proposing an especially suitable method for the manufacture of strings from polyvinylidene fluoride (PVDF). The process for the production of a string according to the invention provides that a rod of polyvinylidene fluoride is extruded at a melt temperature of the polyvinylidene fluoride of between 250° and 350° C., preferably between 260° and 280° C., and cooled to a temperature of between 60° and 150° C., preferably between 130° and 145° C., and is axially stretched at this temperature, whereupon the thus-obtained polyvinylidene fluoride monofil is cooled to room temperature (about 20° C.) and then stretched under these cold conditions. By the combination of the process steps according to the invention, namely a warm-stretching step with a cold, but relatively minor subsequent stretching of the monofils, the superior properties required for a string are attained, namely an elastic behavior approaching that of natural gut strings and remaining uniform over long periods of time, and a reduction in the relaxation of the polyvinylidene fluoride to a value acceptable for playing characteristics. Preferably, the cold-stretching of the polyvinylidene fluoride monofil is conducted to such an extent that a lengthening of the monofil takes place by 1–3%. This extent of cold-stretching is sufficient to attain the desired reduction in relaxation. During the subsequent cold-stretching step, the knot-tearing strength and the ultimate elongation are hardly altered for practical purposes; whereas elasticity is increased somewhat. The attainable elasticity, knot-tearing strength and ultimate elongation of the polyvinylidene fluoride monofil also depend on the temperature at which the warm-stretching step is conducted. The temperature for the warm-stretching step and also the stretching ratio, preferably selected to be between 1:3 and 1:10, preferably 1:4 to 1:5, also depend on the required final thickness or diameter of the monofil string. To obtain, for example, a final thickness of 1.2 to 1.5 mm. for the monofil polyvinylidene fluoride string, the thickness of the cord to be stretched must be chosen to be between 2.7 and 3.5 mm. at a stretching ratio of 1:5 and between 3.4 and 4.2 mm. at a stretching ratio of, for example, 1:8.

It is also advantageous to subject the PVDF monofils, warm-stretched at a temperature of between 130° and 145° C., prior to cooling to room temperature furthermore to a temperature lying somewhat above the stretching temperature, to diminish stresses.

The desired cold-stretching step is obtained, for example, according to the invention by winding up the polyvinylidene fluoride monofil with a uniform tensile force of at least 200 N (N=Newton=Kg·m/sec$^2$), preferably 230–280 N, and allowing it to remain wound up under tension for at least five minutes, preferably for up to one hour or optionally longer, until it is passed to its use after having been relieved of its tension.

The invention will be explained in greater detail below using a tennis racket string as the example. The properties of significance for practical usage of the string of this invention made of polyvinylidene fluoride for stringing tennis rackets will be briefly described below. It is furthermore to be noted that tennis racket strings, when being strung, are tightened with a pretensioning force, depending on the type of game of the player, of between 150 N and 300 N, preferably about 200 N. The following requirements result:

(a) Tensile Strength

On the basis of the stress-strain diagram of a tennis ball, an estimate can be made that about 50–250 N of force is absorbed by the stringing of the tennis racket. These forces are distributed among the individual strings of a tennis racket in various ways. Since, in general, the longitudinal strings have a higher pretensioning than the transverse strings, these forces are absorbed to a greater degree by the longitudinal strings and to a lesser degree by the transverse strings. The force exerted by a ball on a string should, per estimate, not be more than 50 N in case of average players. This force is added to the pretensioning force of a string of 160–300 N, by which a string is pretensioned during mounting.

(b) Tension Relaxation

The tennis racket strings are pretensioned, depending on the player and the type of game, with 160–300 N, predominantly with 200 N during stringing. With an increasing tension, the deformation distance is reduced and the contact time between the ball and the stringing is shortened so that generally the guidance of the ball is poorer and a high speed of the tennis racket is required for accelerating the ball. The tension of the strings should vary with the time to a minimum extent, i.e. the tension relaxation is to be low. Furthermore, the tension is to change only to a minimum extent due to the effects of temperature and moisture.

(c) Knot Tear Strength

The strings must have an adequate knot tear strength, but it is possible to reduce the force acting on the knot by repeatedly turning the string during stringing.

(d) Elasticity Behavior

One of the most important properties of the tennis racket strings is the elasticity behavior in case of tensile forces of about 200 N. This can be varied within a certain range, due to the nonlinearity of the stress-strain diagram, by the choice of the tension and/or by the diameter of the strings. This property has an effect on the ball acceleration, the ball control, and the stress on the elbow joint. Too long a deformation path causes too low a ball acceleration, and a deformation path which is too short causes a poor ball control. The natural gut strings, according to all experience gained heretofore, exhibit an elasticity behavior ensuring a satisfactory ball control and acceleration as well.

(e) Restoring Power

The string, after short-term stress, is to return rapidly to its initial condition. This means that the internal friction of the material utilized is to be low. A measure for this is the attenuation.

(f) Abrasion Resistance

The wear characteristic is determined, on the one hand, by the rubbing of two strings at the points of intersection of a stringing, but, on the other hand, also by dust and dirt.

The following description relates to the manufacture of a monofil string from polyvinylidene fluoride according to the invention, which is to be used as a tennis racket string, and this string is investigated with respect to its properties and compared to a multifil synthetic resin string of the type "Hy-O-Sheep" by Rucanor GmbH, Cologne, and a natural gut string of the type "Victor Imperial" by Hoffman von Cramm KG, Unteraching.

With the use of a single-screw extruder, a rod of polyvinylidene fluoride ("Dyflor" type M by Dynamit Nobel AG) is extruded with a diameter of 2.6 mm. at a melt temperature of 275° C. and cooled, in a subsequent glycerin bath of about 95° C., to about the temperature of the bath. The rod is then introduced into a tempering bath of glycerin having a temperature of 145° C. and stretched at a ratio of 1:4 at this temperature.

The thus-obtained monofil of polyvinylidene fluoride has a diameter of 1.3 mm. and is subsequently cooled in a bath held at about 20° C. The monofil then has an elasticity of about $5.5 \cdot 10^{-4} \cdot N^{-1}$. The monofil, cooled to room temperature, is thereafter wound up on steel reels with a uniform tension of 250 N and held under tension on the winding reel for about one hour. During this time, however, the tension drops from 250 N to about 180 N. It is possible, by a more vigorous, one-time stretching at higher temperatures, to obtain strings having the same elasticity and an equal or better relaxation behavior as compared to natural gut strings. If these springs are mounted with this pretensioning, a reorientation of the molecules takes place in the tension direction, by which the elasticity is lowered. The elasticity of the monofils in the mounted condition rises due to applied pretensioning. At the same time, a reduction in the pretensioning occurs due to the reorientation.

One could assume that the subsequent cold-stretching step may be generally omitted and this process step is conducted only upon stringing the strings. In such a case, it has been found that stringing would have to take a substantially longer period of time; besides, uniformity in the elasticity would then not be ensured. After one hour, the monofil of polyvinylidene fluoride is unreeled again and is now ready for use to be strung as a string on a tennis racket.

The thus-prepared monofil of polyvinylidene fluoride now exhibits, with a pretensioning strength of 200 N, with which it is strung on the tennis racket, an elasticity corresponding to that of high-quality natural gut strings, and the relaxation behavior, at pretensioning forces of 200 N, is equal to or even lower than that of high-quality natural gut strings.

After relaxation, the subsequently cold-stretched monofil is longer by about 1.5% than the monofil which has not been stretched over a period of one hour with a tensioning force of 250 N. By means of this subsequent cold-stretching, the desired low relaxation is attained, with a high elasticity of the polyvinylidene fluoride monofils.

The string of the present invention as well as the properties of the string made of a polyvinylidene fluoride monofil, as compared to the above-specified natural gut string as well as a high-quality conventional synthetic resin string of polyamide, are illustrted in the following figures, wherein:

FIG. 1 is a perspective view of a monofil of polyvinylidene fluoride useful as the string of this invention;

FIG. 1*a* shows a perspective view of a twisted bundle of three polyvinylidene fluoride monofils;

Initially, it will be seen that the following tble provides a comparison of the mechanical properties of the string of this invention and other known strings.

TABLE 1

Comparison of the Mechanical Properties

| Name of Material | Density (mm.) | Tear Strength (N) | Ultimate Elongation % | Knot Tear Strength (N) | Abrasion Resistance No. of Cycles | Elasticity of Pretensioning of 150-350 N |
|---|---|---|---|---|---|---|
| Natural gut string 1 "Victor Imperial" | 1.3 | 440 | 15 | 200 | 2,000-15,000 | 2.7 ~ 3.3 $N^{-1}$ |
| Synthetic resin string 2 (PA) "Hy-O-Sheep" | 1.4 | 750 | 25 | 400 | >50,000 | 2.8 ~ 1.6 $N^{-1}$ |
| PVDF Monofil string 3 | 1.3 | 480 | 20 | 350 | 300-2,000 | 3.1 ~ 3.8 $N^{-1}$ |
| PVDF Monofil string with "Teflon" ® surface | 1.3 | 480 | 20 | 350 | 20,000-50,000 | |
| PVDF Monofil string coated with silicone | 1.3 | 480 | 20 | 350 | >50,000 | |

It will be understood that the elasticity $\alpha$ is defined as the ratio of the change in elongation $\Delta\epsilon$ at a change in force $\Delta\kappa$:

$$\alpha = \frac{\Delta\epsilon}{\Delta\kappa}$$

$\Delta\epsilon$=change in elongation;

$\Delta\kappa$=change in force;

for a reversible deformation.

Figure 1:
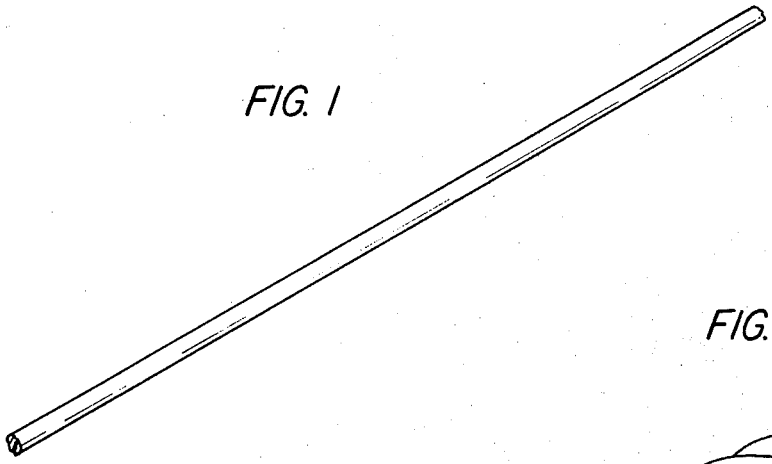
Figure 1A:
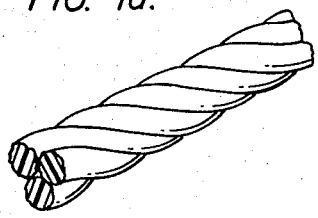
Figure 2:
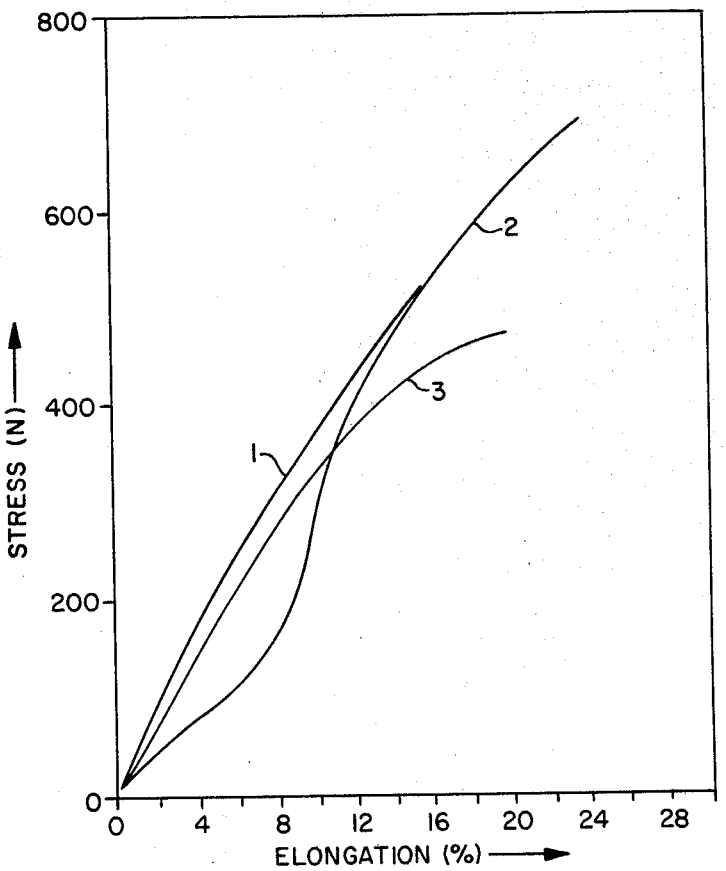
FIG. 2 shows a stress-strain diagram.
Figure 3:
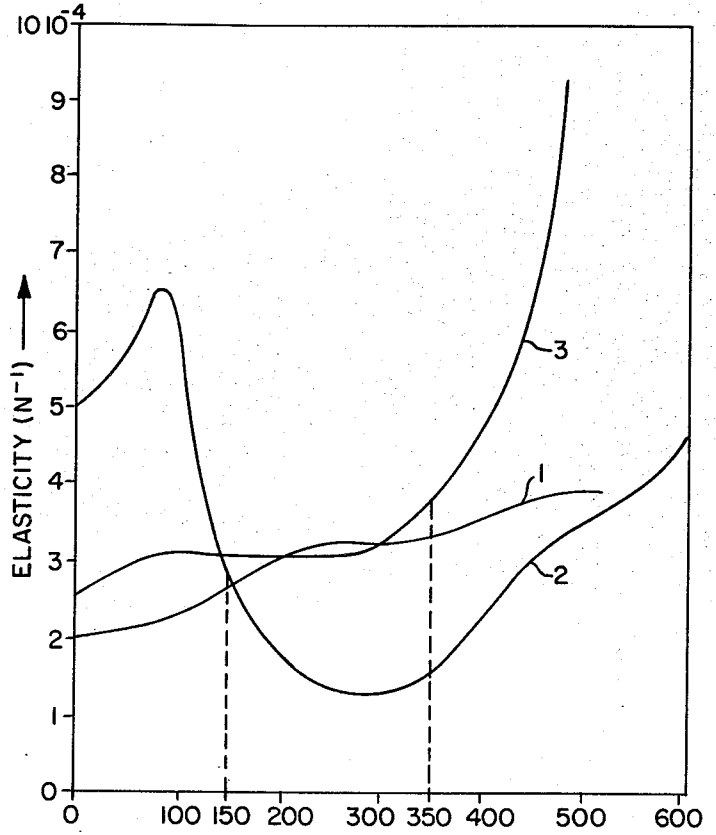
FIG. 3 represents the elasticity as a function of the pretensioning force.

The elasticity can be determined from the stress-elongation diagrams of FIG. 2. The elasticity as a function of the pretensioning is represented by FIG. 3. It can be seen therefrom that the PVDF monofils produced according to this invention, at pretensioning forces of about 150 N to 350 N, have practically the same elasticity as high-quality natural gut strings. In contrast thereto, the "synthetic resin strings" just as the monofils of polyamide, with a pretensioning force of 200 N, show a substantially lower elasticity.

Figure 4:
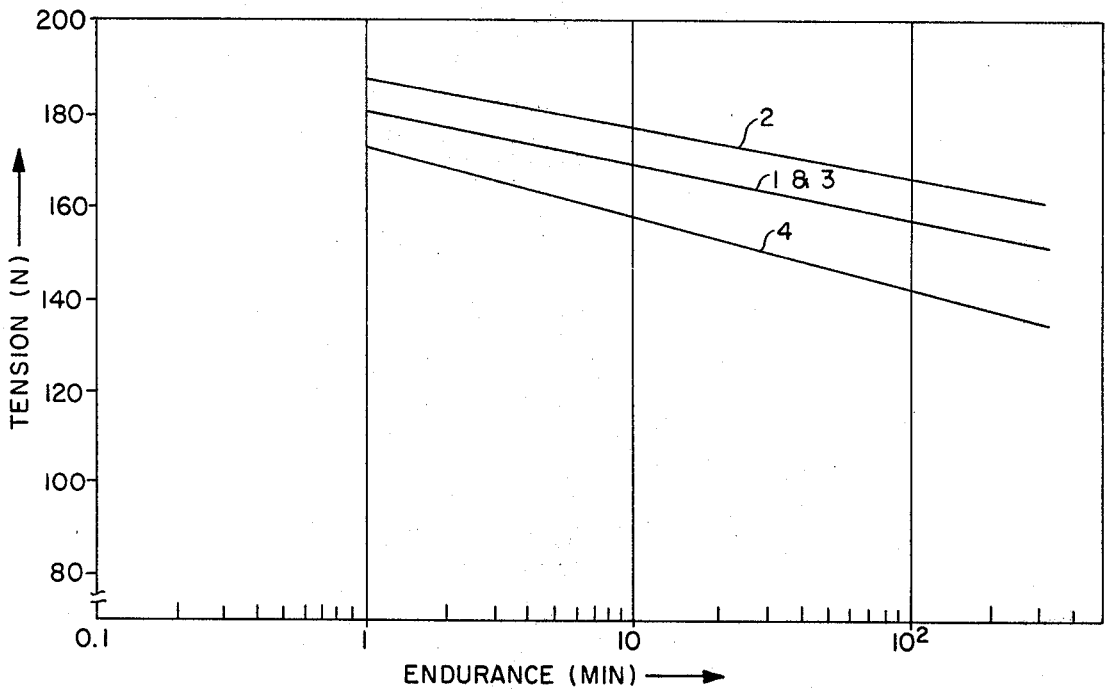
FIG. 4 shows the chronological curve of the tension after the application of a force (relaxation)
Figure 5:
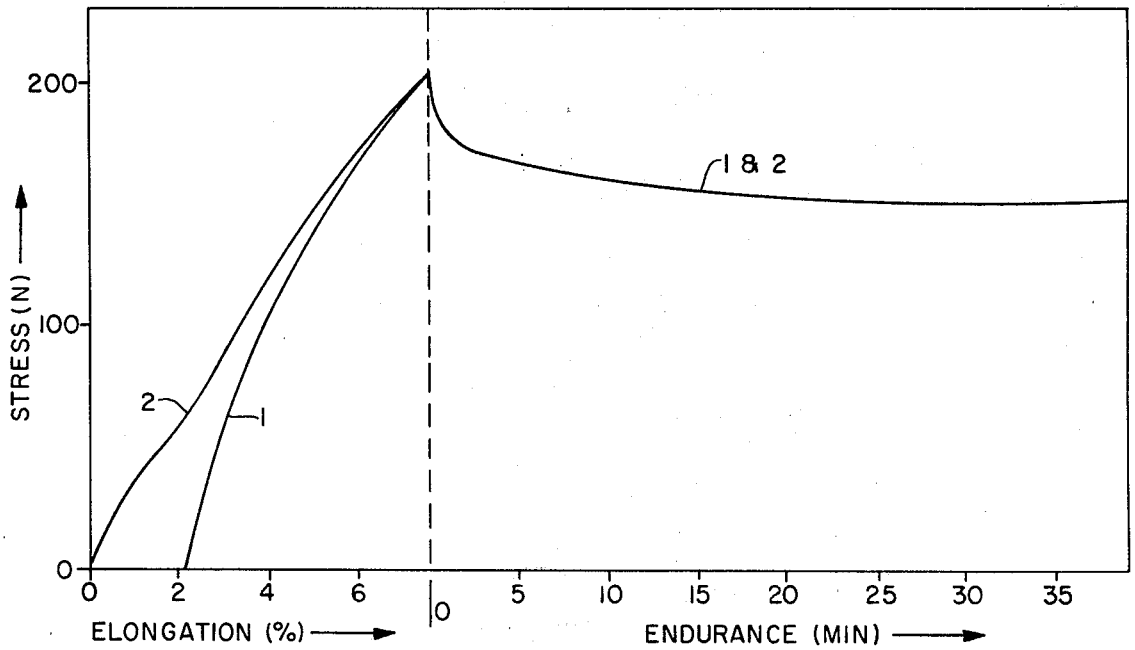
FIG. 5 depicts the stress-elongation behavior.

Relaxation also as mentioned in claim 13 was determined in accordance with DIN [German Industrial Standard]53 441. The change in force $\Delta\kappa$ as a function of the time shown as logarithmen of of time $\Delta \log_{10} t$ at constant elongation and with a pretensioning force of 200 N is shown in FIG. 4. The PVDF monofils have about the same relaxation as the high-quality natural gut strings, but the starting material, prior to cold-stretching, exhibits a substantially higher relaxation.

FIG. 15 depicts the stress-elongation characteristic of a PVDF monfil, produced according to the method of this invention, and a high-quality natural gut string. The zero point of the stress-elongation diagrams was shifted so that the curves contact one another at a force of 200 N. In this type of representation, it can be seen that the two materials are equivalent with respect to their elasticity characteristics. The difference between the two materials resides in that, for reaching a force of 200 N, an elongation of 7.5% is required in the PVDF monofils described herein, and an elongation of about 5% is necessary in the high-quality natural gut strings. The relaxation behavior of both strings is likewise the same.

Figure 6:
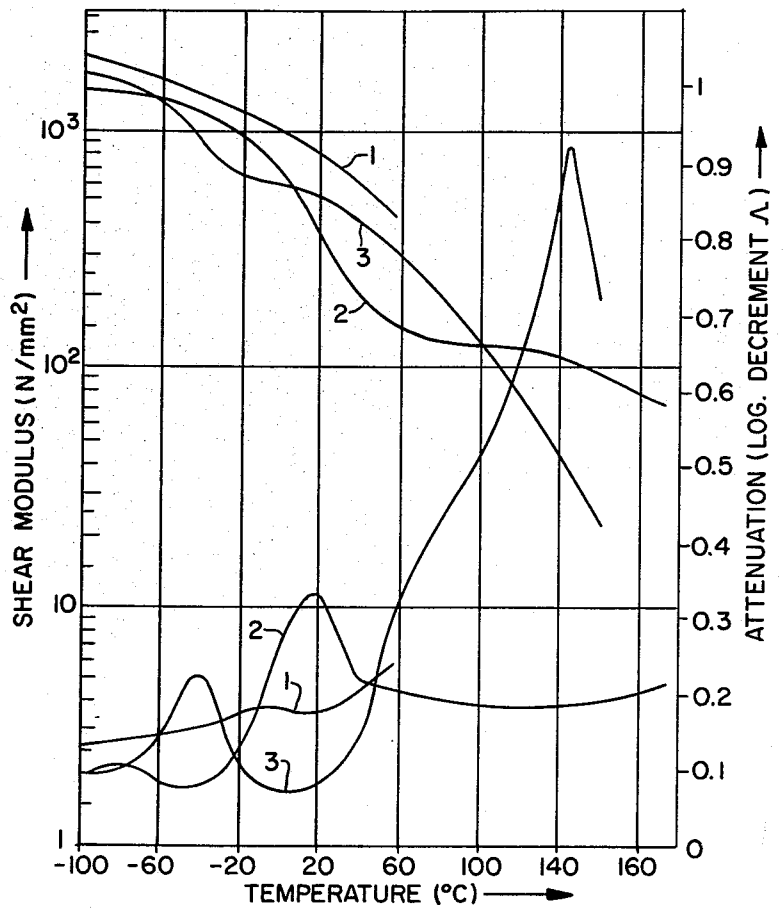
FIG. 6 shows the dependency of shear modulus and attenuation on the temperature.
Figure 7:
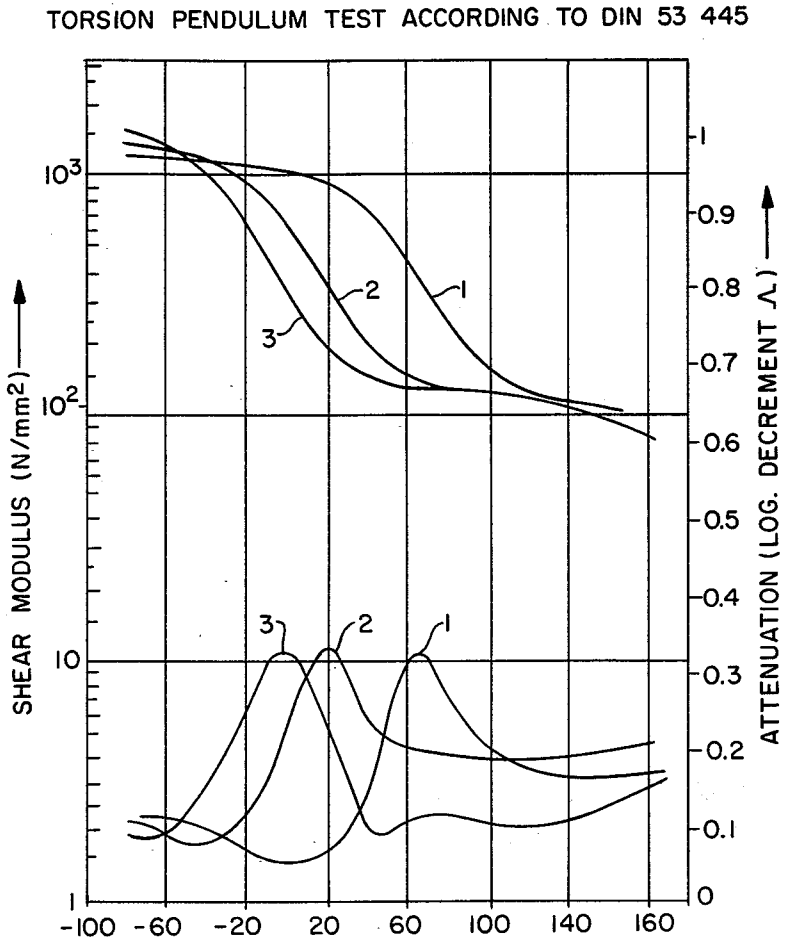
FIG. 7 shows the dependency of the shear modulus and the attenuation of polyamide 6.6.

The temperature characteristic of high-quality natural gut strings, "synthetic resin strings," and monofils of PVDF can be seen from the temperature curves of the shear modulus and attenuation (FIG. 6). Measurement is conducted according to DIN 53 445. The monofils of PVDF show only a slight change of the shear modulus in the temperature range of 15° C. The same holds true for the high-quality natural gut strings. In contrast thereto, the synthetic resin strings show a very great change, especially those made of polyamide, in this temperature range. This change is due to the fact that due to the moisture content the glass transition temperature of the polyamide is lowered and the moisture saturation at 23° C. and 50% relative humidity results in a glass transition temperature of 20° C., as shown by the comparative illustration in FIG. 7. It can furthermore be seen from FIG. 6 that the PVDF monofils at 20° C. show very minor attenuation; for this reason, these monofils have a very good restoring capacity.

Figure 8:
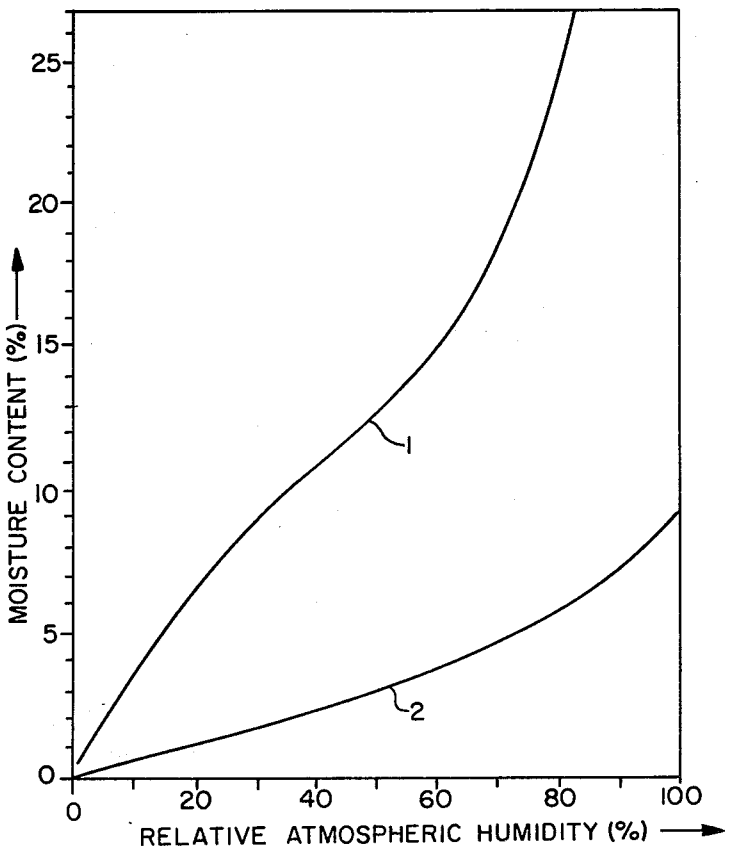
FIG. 8 shows the effect of moisture (sorption isotherms).

The effect of moisture can be characterized best by the sorption isotherms, as shown in FIG. 8. While in case of the PVDF monofil the moisture content remains below 0.2% even at 100% relative humidity, this moisture content ranges at about 9% in case of polyamide strings and is >90% in case of natural gut strings.

The tear strength was determined according to DIN 53 455. Concerning the knot tear strength, a knot was made in the string to be tested, and then the tear strength was measured on the string in the tensile strength test according to DIN 53 455. The characteristic values are compiled in the Table.

Abrasion resisance was determined by means of a special test instrument. Two strings are clamped in place in intersecting relationship, each with a pretensioning force of 200 N. The tensioning clamps for one string are fixed, the tensioning clamps for the other string are movable. The movable string is pulled from above under the fixed string and extended upwardly. With a speed of 100 cycles per minute, this string is moved to and fro. The point of intersection of both strings can shift to and fro during testing by about 10 mm. The abrasion resistance determined with this device is most advantageous in case of the tennis racket strings made of polyamide. The natural gut strings differ very greatly with respect to abrasion resistance. There are strings which rupture already after 600 cycles; whereas others rupture only after 2000 cycles. PVDF monofils exhibit an abrasion resistance slightly poorer that that of the natural gut strings. However, PVDF monofils, the surface of which have been coated, for example, with "Teflon," have abrasion resistances substantially higher than the abrasion-resistant natural gut strings as shown in the tabulation of data.

A comparison of the characteristic values of tennis racket strings made of PVDF monofils, high-quality natural gut, and "synthetic resin strings" shows that the PVDF monofil string does not exhibit a large number of the disadvantages displayed by the natural gut strings as well as the conventional synthetic resin strings, while due to the subsequent cold-stretching step the PVDF monofil string can be adjusted so that the elasticity as well as the relaxation of this PVDF string are comparable to those of high-quality natural gut strings.

Tennis rackets strung with these PVDF monofils showed in their playing characteristics a similar behavior as a stringing made of high-quality natural gut.

We claim:

1. A string for the stringing of rackets, bows, musical instruments and the like comprising a thread-like structure comprising at least one polyvinylidene fluoride monofil of a thickness of 1.2 to 1.5 mm, which is stretch oriented to impart improved elasticity thereto and which is provided with a coating consisting essentially of polytetrafluoroethylene or a silicone oil.

2. A string according to claim 1, wherein the structure comprises a bundle of polyvinylidene fluoride monofils which are joined together.

3. A string according to claim 1, wherein the structure comprises a bundle of polyvinylidene fluoride monofils which are twisted together.

4. A string according to claim 1, wherein the structure comprises a bundle of polyvinylidene fluoride monofils which are braided together.

5. A string according to claim 1 or claim 2, wherein the elasticity of the polyvinylidene fluoride monofil, at a pretensioning force in the range between 170 and 320 N, approaches that of a natural gut string.

6. A string according to claim 5, wherein the relaxation of the polyvinylidene fluoride monofil, at a pretensioning force of 200 N, is equal to or lower than that of the natural gut string.

7. A string according to claim 1 or claim 2, wherein the elasticity of the polyvinylidene fluoride monofil, at a pretensioning force of 200 N, is between 2.0 to $5.0 \cdot 10^{-4}\ N^{-1}$.

8. A string according to claim 1 or claim 2, wherein the polyvinylidene fluoride monofil is a monofil that has been axially stretched in a ratio of between 1:3 and 1:10, to effect stretch orientation of polyvinylidene fluoride.

9. A string according to claim 8, wherein the polyvinylidene fluoride monofil is a monofil that has subsequently been stretched at least once, the subsequent stretching effecting an elongation of the polyvinylidene fluoride monofil of between 1% and 3% whereby the elasticity of the monofil is set to a desired value.

10. A string according to claim 1 or claim 2, wherein the polyvinylidene fluoride monofil is a monofil that has been axially stretched in a ratio of between 1:4 to 1:5 to effect stretch orientation of polyvinylidene fluoride.

11. A string according to claim 8, wherein the polyvinylidene fluoride monofil is a monofil that has been stretched at least twice, once at a temperature of from 60°–150° C. and subsequently at room temperature.

12. A string according to claim 1 or claim 11, wherein said monofil is useful as a stringing for ball rackets, especially tennis rackets, said monofil having an elasticity of 2.7 to $3.6 \cdot 10^{-4}\ N^{-1}$ at a pretensioning force of 200 N, an ultimate elongation of 16–30%, a tear strength of between 300 and 500 $N/mm^2$, a knot tear strength of 200–500 N, and a relaxation $$\frac{\Delta \kappa}{\Delta \log_{10} t} < 10\ N$$

at a diameter of the string of 1.2–1.5 mm.

* * * * *